US006993282B2

(12) United States Patent
Kimizuka

(10) Patent No.: US 6,993,282 B2
(45) Date of Patent: Jan. 31, 2006

(54) SHEET CONVEYING APPARATUS AND IMAGE FORMING APPARATUS

(75) Inventor: Eiichiro Kimizuka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/803,927

(22) Filed: Mar. 19, 2004

(65) Prior Publication Data

US 2004/0190964 A1 Sep. 30, 2004

(30) Foreign Application Priority Data

Mar. 31, 2003 (JP) ..... 2003-095517

(51) Int. Cl.
*G03G 15/00* (2006.01)

(52) U.S. Cl. ..... 399/401; 399/402

(58) Field of Classification Search ..... 399/401, 399/402, 405, 397; 271/301, 264, 90
See application file for complete search history.

(56) References Cited

U.S. PATENT DOCUMENTS 6,149,045 A 11/2000 Kadono ..... 226/196.1

FOREIGN PATENT DOCUMENTS

EP 0 374 575 A2 6/1990
JP 59-211065 A 11/1984

*Primary Examiner*—Anthony H. Nguyen
(74) *Attorney, Agent, or Firm*—Fitzpatrick, Cella, Harper & Scinto

(57) ABSTRACT

A sheet which is again conveyed to an image forming section passes through a re-feeding passage. A reference member is provided on one end of the re-feeding passage which is perpendicular to a sheet-conveying direction, and is provided with a plurality of reference surfaces in a stepwise manner. Side ends of sheets having different sizes and passing through the re-feeding passage abut against the reference surfaces to adjust positions of the sheets in widthwise direction. The re-feeding passage is provided with obliquely conveying means which obliquely conveys the sheets having different sizes while pushing the sheets against the reference surfaces. A support member which is provided upstream of the obliquely conveying means supports the sheet such that one end of the sheet supported by the support surface extending from lower ends of the reference surfaces substantially horizontally and the other end of the sheet have substantially the same heights.

13 Claims, 11 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus and more particularly, to an apparatus in which a sheet whose first surface is formed with an image by an image forming section is re-fed to the image forming section for forming an image on the second surface of the sheet which is opposite side from the first surface.

2. Description of the Related Art

There is known image forming apparatuses such as copiers, printers and facsimile machines in which an image is formed on the first surface of a sheet by an image forming section and an image is formed on the second surface of the sheet which is opposite side of the sheet.

In order to form images on both surfaces of a sheet, such an image forming apparatus includes re-feeding means which, after an image is formed on one surface of the sheet, again supplies the sheet to the image forming section to form an image on the back surface.

A configuration of the conventional re-feeding means will be explained based on FIGS. 8 to 11.

After an image is formed on the first surface of a sheet S, the sheet S is turned over, the sheet passes through a re-feeding passage 18, the sheet is fed by a pair of obliquely conveying rollers 11*a* and 11*b*, and the sheet is fed to the image forming section again. The pair of obliquely conveying rollers comprise an obliquely conveying roller 11*a* and an obliquely conveying follower roller 11*b* which comes into contact with the obliquely conveying roller 11*a* under pressure. In the image forming section, the second surface of the sheet is formed with an image.

In such a configuration, when the sheet S is re-fed to the image forming section, the sheet S is inclined during the conveying operation and deviated from a conveying-reference, and when an image is formed on the second surface, the sheet S and the image are deviated from each other in some cases. This is because that when an image is formed on the second surface, a conveying path of the sheet required until an image is formed on the second surface of the sheet is longer than a case in which an image is formed on the first surface and thus, the sheet is slightly deviated from the conveying-reference during the conveying operation due to eccentricity of the rollers, a difference in pressure or a different in resistance of a conveying surface.

In order to prevent the sheet S from being deviated, it is necessary to adjust the position of the sheet S in its widthwise direction after an image is formed on the first surface and before an image is formed on the second surface, and to adjust the position of the sheet S such that the image and the sheet S coincide with each other. To adjust the position, there is a method in which during the conveying operation of a sheet, the sheet is fed while pushing the sheet against a reference member which functions as a positioning reference disposed on an end of the re-feeding passage 18, thereby correcting the inclination and to align the sheet with the conveying-reference.

FIG. 8 is a plan view showing a configuration of the re-feeding passage 18 having the re-feeding means, FIG. 9A is a front view thereof and FIG. 9B is a side sectional view thereof.

In FIGS. 8 and 9, a reference number 13 represents roller shafts for two obliquely conveying rollers 11*a*. As shown in FIG. 9A, the roller shafts 13 are held by bearings 14 such that the roller shafts 13 can rotate with respect to a reference guide 12 which is a reference member.

Pulleys 15 are fixed to ends of the two roller shafts 13. The roller shafts 13 are driven by belts 16*a* and 16*b* which are wound around the pulleys 15. The obliquely conveying rollers are driven by a driving motor (not shown) through the belts 16*a* and 16*b*.

A reference number 17 represents pins which rotatably holds obliquely conveying follower rollers 11*b*. The pins 17 are held by a conveying upper guide 19 which forms an upper surface (ceiling surface) of the re-feeding passage 18. A reference number 181 represents springs which push the pins 17 from above. The obliquely conveying follower rollers 11*b* come into contact with the obliquely conveying rollers 11*a* by the springs 181 under given pressure.

Here, the re-feeding passage 18 is a so-called one side reference type in which one side of a sheet S is pushed against the reference guide 12 to adjust a position of the side end of the sheet S. The reference guide 12 is provided with a plurality of, e.g., first and second reference guide surfaces 12*a* and 12*b*. A reference number 20 represents conveying lower guide forming a lower surface of the re-feeding passage 18 together with the reference guide 12.

In the re-feeding passage 18 which adjust a position of the sheet S by the one side reference, the sheet S fed in the direction of arrow A in FIG. 8 is obliquely fed by the obliquely conveying rollers 11*a* and the obliquely conveying follower rollers 11*b*.

The obliquely conveying rollers 11*a* and the obliquely conveying follower rollers 11*b* are inclined at given angle so that a force in the direction of the reference guide surface is applied to the sheet S so as to push the sheet S against the reference guide surfaces 12*a* and 12*b*. With this configuration, the sheet S is fed while changing its orientation toward the reference guide surfaces, and the end of the sheet S is pushed against the reference guide surfaces 12*a* and 12*b*, thereby correcting the inclination of the sheet, and the position of the sheet S is adjusted with respect to the conveying-reference.

In order to adjust an attitude of the sheet S, if the force of the pair of obliquely conveying rollers 11*a* and 11*b* in the direction of the reference guide surface which pushes the side end of the sheet S against the reference guide surfaces 12*a* and 12*b* and conveys the sheet S along the reference guide surfaces 12*a* and 12*b* is sufficient, one of the obliquely conveying roller 11*a* and the obliquely conveying follower roller 11*b* may be inclined at a given angle.

Thus, the first and second reference guide surfaces 12*a* and 12*b* against which the side end of the sheet S is abutted is determined by a length of the sheet S in its widthwise direction. For example, the first reference guide surface 12*a* has side end reference of sheet S of letter size and A4 size, and the second reference guide surface 12*b* has side end reference of sheet S of executive size and B5 size.

In the case of a sheet of A4 size whose widthwise length is about 6 mm shorter than that of the letter size, since the position is adjusted by the same first reference guide surface 12*a* as that used for a sheet of letter size, it is necessary to correct such that an image is formed on the second surface while deviating the image by 3 mm in the lateral direction as compared with a case in which an image is formed on a letter size sheet. For the executive size sheet and B5 size sheet also, the same correction is necessary.

FIG. 10 show the re-feeding passage 18 capable of conveying sheet S1 of A5 size which is smaller than the above sheet S. Since this re-feeding passage 18 conveys the sheet S1 of A5 size, the re-feeding passage 18 is provided with a reference guide 12 having a third reference guide surface 12*c* so as to fit the sheet S1 having smaller width.

When such a smaller sheet S1 is supplied again, since the length of the sheet S1 in the sheet conveying direction is short, the length of the sheet S1 becomes shorter than distances between a conveying roller 3*g* shown in FIG. 7 and the pair of upstream obliquely conveying rollers 11*a* and 11*b*, and it becomes difficult to convey the small sheet S1.

When the small sheet S1 is to be fed, auxiliary rollers 11*a*' shown in FIG. 10 are added at upstream of the pair of obliquely conveying rollers 11*a* and 11*b* so that the small sheet S1 can be fed. Since the auxiliary rollers 11*a*' are added, a belt 16*c* is also added so that three roller shafts 13 can be driven.

As shown in FIG. 11A, the reference guide surfaces 12*a*, 12*b* and 12*c* respectively having different size are inclined stepwisely in the widthwise direction of a sheet, a support surface 12*a*1 horizontally extends from a lower end of the first reference guide surface 12*a* and supports one end of letter size sheet and A4 size sheet. The support surface 12*a*1 is located higher than a guide surface 20*a* of a conveying lower guide 20 which guides the other end of the sheet.

With this configuration, a height difference exists between the reference guide 12 and the conveying lower guide 20. When such a height difference exists, if A4 size sheet S is fed into a paper re-feed unit in the direction of arrow B as shown in FIG. 11B, a difference is generated in a paper-pass length in the conveying direction, and due to this difference in paper-pass length, the sheet S is inclined.

If the sheet S is inclined at upstream of the pair of obliquely conveying rollers 11*a* and 11*b*, the tip end corner of the sheet S closer to the reference guide surface is separated from the first reference guide surface 12*a* and fed.

Even if the tip end corner of the sheet S closer to the reference guide surface is separated from the first reference guide surface 12*a* in this manner, if the sheet S is nipped between the pair of obliquely conveying rollers 11*a* and 11*b* thereafter, since a force for moving the sheet S toward the reference guide surface is usually applied to the sheet S, when the sheet S is to be discharged out from the paper re-feed unit, the sheet S is discharged in a state in which the side end of the sheet is along the first reference guide surface 12*a*.

However, if the height difference is excessively large, the pair of obliquely conveying rollers 11*a* and 11*b* can not move the sheet S toward the reference guide surface in some cases. In such a case, the precision of image forming position of the second surface is adversely affected.

SUMMARY OF THE INVENTION

Hence, the present invention has been accomplished in view of the circumstances, and it is an object of the invention to provide a sheet conveying apparatus and an image forming apparatus having the sheet conveying apparatus capable of reliably positioning a sheet.

The present invention provides a sheet conveying apparatus having a positioning mechanism for adjusting a conveying position of a sheet which is conveyed when the sheet is conveyed, the positioning mechanism comprising; a plurality of reference surfaces formed by a stepwise manner in accordance with size of a sheet for adjusting a position of the sheet in a direction perpendicular to a sheet-conveying direction, obliquely conveying means for obliquely conveying the sheet and for conveying the sheet while pushing a side end of the sheet against the reference surface in accordance with size of the sheet, a curved guide surface provided with a upstream side of the reference surfaces for guiding the sheet, and a support member projecting from the curved guide surface for bringing up a side end of the sheet opposite from the side end of the sheet pushed against the reference surfaces.

DESCRIPTION OF THE PREFERRED EMBODIMENT

Embodiments of the present invention will be explained in detail using the drawings.

First, an outline configuration of a laser beam printer will be explained using FIG. 7. This laser beam printer is one example of an image forming apparatus having a sheet conveying apparatus to which the present invention is applied.

Figure 7:
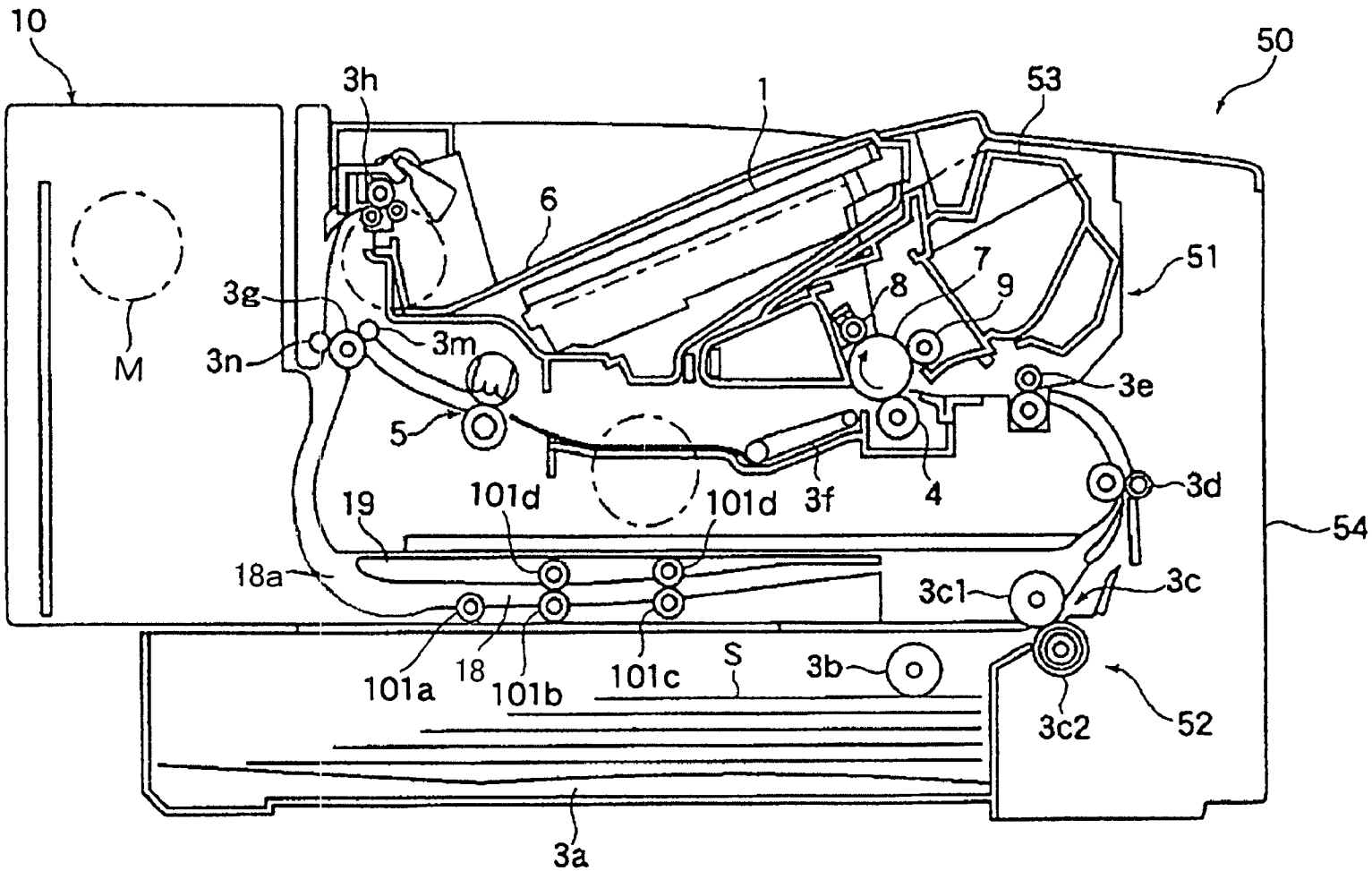
FIG. 7 illustrates an outline configuration of a laser beam printer as one example of an image forming apparatus to which the invention is applied.
Figure 8:
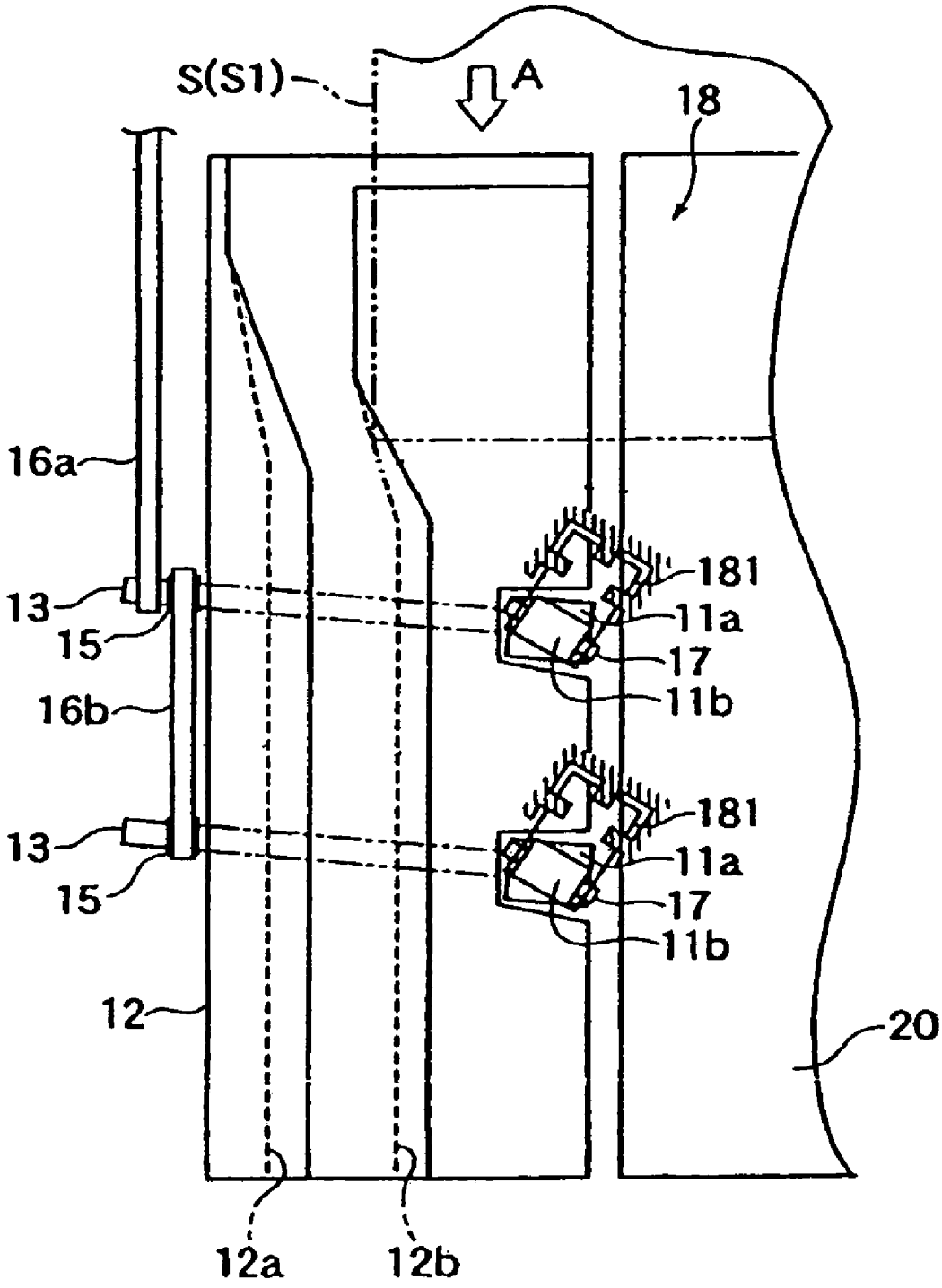
PRIOR ART F I G. 8
FIG. 8 is a plan view for explaining a configuration of a re-feeding passage of a conventional paper re-feed unit.

In FIG. 7, a reference number 50 represents a laser beam printer which forms an image by electrophotographic system. The laser beam printer 50 includes an image forming section 51 which forms an image, and a feeding section 52 for feeding sheets S to the image forming section 51 one sheet by one sheet. The laser beam printer 50 is optionally provided with a paper re-feed unit 10 which is re-feeding means (sheet conveying apparatus). The re-feeding means is for supplying a sheet S again to the image forming section 51 to form an image on its back surface after a front surface is formed with an image so that images can be formed on both surfaces of the sheet S.

The image forming section 51 includes a process cartridge 53, a transfer roller 4 and the like. The feeding section 52 includes a paper-feed cassette 3*a* loading the sheets S, a pick-up roller 3*b* and a pair of separation rollers 3*c* comprising a feed roller 3*c*1 and a retard roller 3*c*2. The process cartridge 53 is integrally provided with a photosensitive drum 7, electrification means 8 which electrically charges a surface of the photosensitive drum 7 uniformly, and developing means 9 for developing an electrostatic latent image formed on the photosensitive drum 7. The process cartridge 53 can be attached to and detached from a laser beam printer body (apparatus body, hereinafter) 54.

In the drawing, a reference number 1 represents a laser scanner unit, a reference number 5 represents photographic fixing means and a reference number 6 represents a discharge tray.

The image forming operation of the laser beam printer 50 having the above-described configuration will be explained next.

Image information is sent to a control section (not shown) from a personal computer (not shown) or the like, the image information is subjected to image forming processing in the control section and then, a print signal is sent from the control section. Then, the photosensitive drum 7 rotates in the direction shown with the arrow, and the photosensitive drum 7 is electrically charged uniformly by the electrification means 8 with predetermined polarity at predetermined potential. The photosensitive drum 7 whose surface has been electrically charged in this manner is radiated with laser beam from the laser scanner 1 based on the image information. With this, an electrostatic latent image is formed on the photosensitive drum 7. Next, this electrostatic latent image is developed by the developing means 9 and becomes visible as a toner image.

The sheets S loaded in the paper-feed cassette 3*a* are conveyed out by the pick-up roller 3*b* during the above toner image forming operation and then, the sheets S are separately conveyed by the pair of separation rollers 3*c*. Thereafter, the sheets S are conveyed to a transfer section comprising the photosensitive drum 7 and the transfer roller 4 by pairs of conveying rollers 3*d* and 3*e*.

A tip end of the sheet S is detected by a resist sensor (not shown) provided at upstream of the transfer section, and the tip end position of the sheet S and the light emitting timing of the laser scanner 1 are synchronized by the control section based on the detection signal of the resist sensor. With this, the toner image formed on the photosensitive drum 7 can be transferred onto a predetermined position on the sheet S.

Next, the sheet S on which the toner image was transferred is conveyed to the photographic fixing means 5 along a conveying belt 3*f*, and is heated and pressurized while the sheet S passes through the photographic fixing means 5, thereby semipermanently fixing the toner image.

In the case of single-side printing, the sheet S which passed through the photographic fixing means 5 is conveyed to nips between the conveying roller 3*g* and the first roller 3*m* which can rotate forward and backward. Then, the sheet S is discharged into the discharge tray 6 by forward rotation of the conveying roller 3*g* and by forward rotation of a discharge roller 3*h* which can rotate forward and backward.

At the time of double-side printing in which both surfaces of the sheet are formed with images, a sheet whose first surface is formed with an image is turned over and conveyed to the image forming section 51 again by the paper re-feed unit 10, and an image is formed on its second surface of the sheet. At that time, after the rear end of the sheet whose first surface was formed with an image passes through the nip between the conveying roller 3*g* and the first roller 3*m*, the discharge roller 3*h* reversely rotates and the sheet which is halfway discharged into the discharge tray 6 is pulled, and the sheet is conveyed to the nip between the conveying roller 3*g* and the second roller 3*n* and is turned over.

Figure 1:
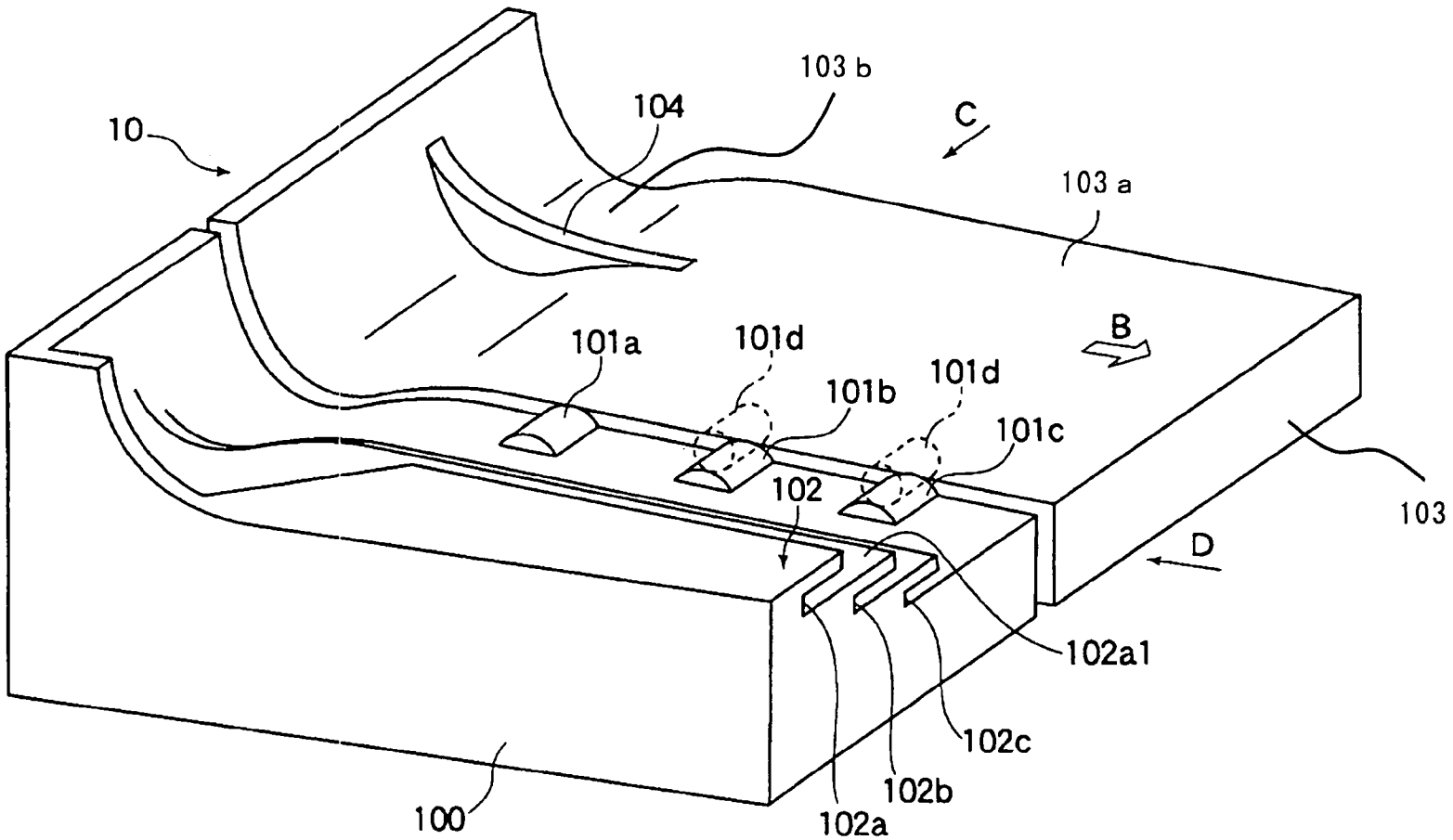
FIG. 1 is a perspective view of a paper re-feed unit which is a sheet conveying apparatus according to a first embodiment of the present invention.

FIG. 1 is a perspective view showing a lower portion of the paper re-feed unit 10 which is the sheet conveying apparatus according to the first embodiment of the present invention. The paper re-feed unit 10 is detachably attached to the laser beam printer 50 optionally.

In FIG. 1, a reference number 100 represents a reference guide. A reference member 102 is provided on one end of the reference guide 100 in its widthwise direction perpendicular to the sheet-conveying direction shown with an arrow B. The reference member 102 is for adjusting a position of the sheet which passes through the re-feeding passage (see FIG. 7) in its widthwise direction with respect to a sheet conveying-reference. The reference member 102 is formed with reference guide surfaces 102*a* to 102*c* in a stepwise manner. The reference guide surfaces 102*a* to 102*c* are reference surfaces extending in the sheet-conveying direction for abutting against side ends of sheets of different sizes to adjust the position of the sheet in its widthwise direction.

In this embodiment, the first reference guide surface 102*a* which is the uppermost reference guide surface serves as a reference of a side end of a sheet of letter size and A4 size. The third reference guide surface 102*c* which is the lowermost reference guide surface serves as a reference of a side end of a sheet of A5 size. The second reference guide surface 102*b* which is the intermediate reference guide surface serves as a reference of a sheet of executive size and B5 size.

Reference numbers 101*a* to 101*c* represents obliquely conveying rollers which are obliquely conveying means. The three obliquely conveying rollers 101*a* to 101*c* are rotatably held by the reference guide 100 and driven by driving means. An obliquely conveying follower roller 101*d* is in contact with the downstream two obliquely conveying rollers 101*b* and 101*c* under given pressure. The obliquely conveying rollers 101*b* and 101*c* are driven by a motor M provided in the paper re-feed unit 10.

A conveying lower guide 103 is provided adjacent to the reference guide 100 and constitutes a lower surface (bottom surface) of the re-feeding passage 18. A fixing rib 104 as a support member of the present invention is provided upstream side of the obliquely conveying roller 101*a* which is most upstream in the conveying direction of the conveying lower guide 103.

Figure 2:
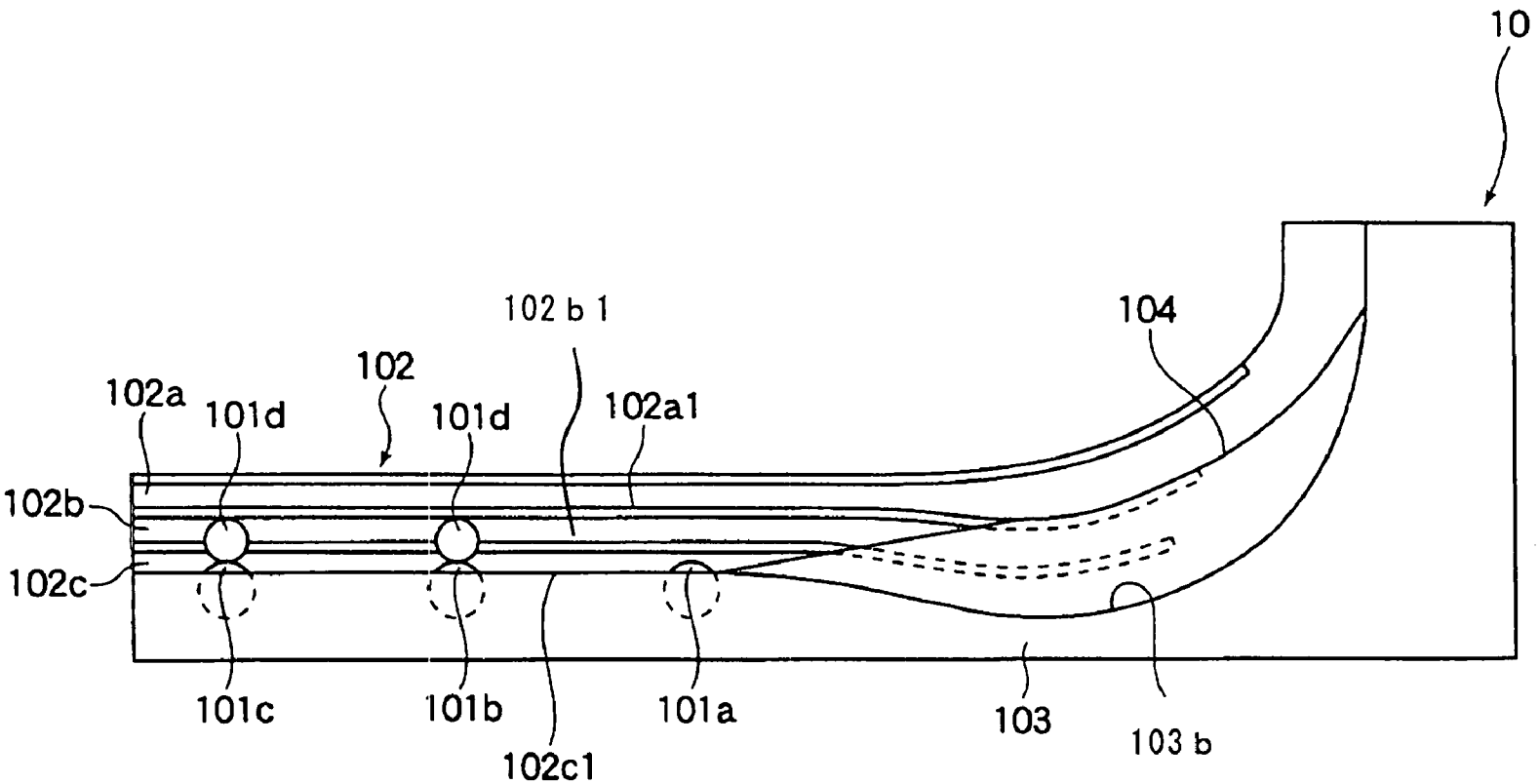
FIG. 2 is a side view of a lower portion of the paper re-feed unit.

As shown in FIG. 2, an upstream side of the guide surface (basic surface) 103*a* of the conveying lower guide 103 has curved guide surface 103*b* which is curved, and the guide surface 103*a* horizontally extends from an upstream side of the third reference guide surface 102*c* which is a reference of the side end of the smallest sheet (sheet of A5 size in this embodiment) of the reference member 102. The guide surface 103*a* has substantially the same height as that of a sheet support surface 102*c*1 which is a support surface for supporting one end of the A5 size sheet. A reason why the curved guide surface 103*b* of the conveying lower guide 103 is curved lower than the sheet support surface 102*c*1 is that even if the height of the apparatus is reduced, sheets can be conveyed stably by reducing the curvature of a conveying path.

Since the guide surface 103*a* of the conveying lower guide 103 has substantially the same height as that of the sheet support surface 102*c*1 of the third reference guide surface 102*c*, it is possible to reliably introduce a sheet of A5 size into the third reference guide surface 102*c*, and to prevent jamming from being generated.

The fixing rib 104 is provided on the curved guide surface 103*b* which is provided upstream side of the reference number 100 on and the fixing rib 104 has substantially the same height as that of a sheet support surface 102*a*1 of the first reference guide surface 102*a* which serves as the reference of side end of maximum sheet of the reference member 102, in this embodiment, sheet of letter size and A4 size.

If the fixing rib 104 is formed at a position close to the first reference guide surface 102*a*, when a sheet of letter size or A4 size passes through the re-feeding passage, since the end of the sheet opposite from the reference member hangs down, the balance of the attitude of the sheet S is deteriorated, and the sheet can not be introduced to the first reference guide surface 102*a* reliably. Thus, the fixing rib 104 is formed at a position away from the first reference guide surface 102*a* with respect to the center line O of the conveyed sheet S in its widthwise direction as shown in FIGS. 3A and 3B.

Figure 3A:
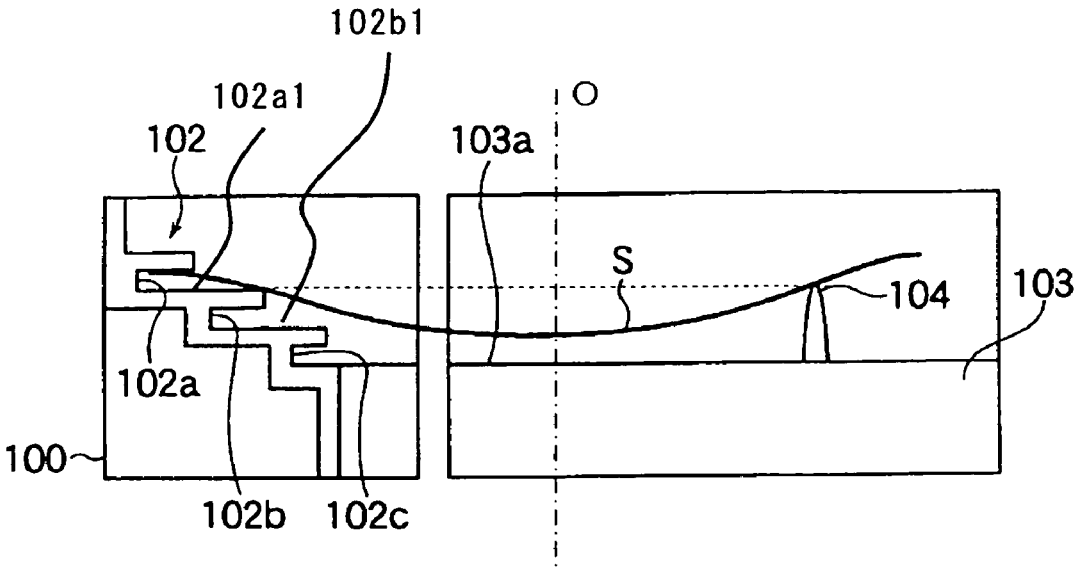
FIG. 3 are a front view and a plan view of the lower portion of the paper re-feed unit.
Figure 3B:
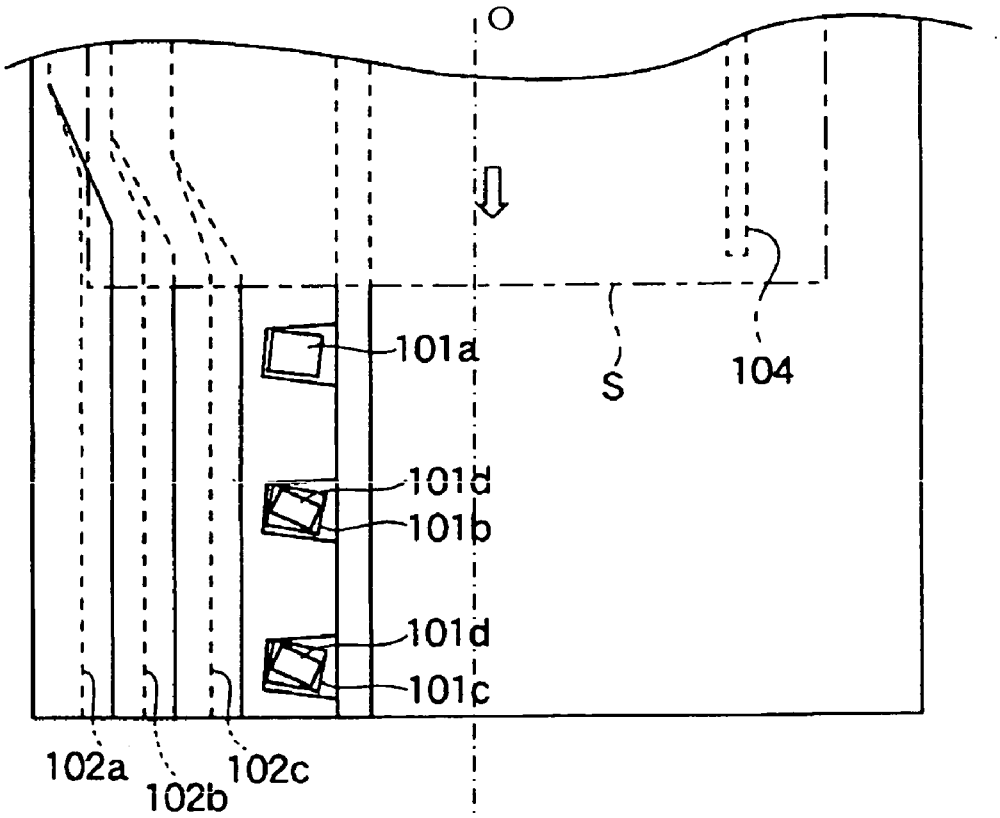

By providing the fixing rib 104 having substantially the same height as that of the sheet support surface 102*a*1 of the first reference guide surface 102*a* at such a position, when the sheet passes through the re-feeding passage as shown in FIG. 3A, a difference between a height of one end of the sheet S supported by the sheet support surface 102*a*1 of the first reference guide surface 102*a* and a height of the other end of the sheet S supported by the fixing rib 104 is eliminated.

Since the difference in height between both ends of the sheet S before the sheet S is conveyed by the obliquely conveying roller 101*a* is eliminated, a difference in paper-pass length in the both ends of the sheet in the conveying direction is eliminated. As a result, the sheet S is not largely inclined, and as shown in FIG. 3B, the reference side end of the sheet S is prevented from separating from the first reference guide surface 102*a* by the difference in height of both the ends at upstream of the obliquely conveying roller 101*a*.

With this configuration, it is possible to easily set the side end of the sheet along the first reference guide surface 102*a* by the obliquely conveying rollers 101*a* to 101*c* and the obliquely conveying follower roller 101*d* while the sheet is re-supplied from the paper re-feed unit 10 to the image forming section (see FIG. 7). Therefore, the obliquely conveying of the sheet can reliably be corrected, and the sheet position can be adjusted to the conveying-reference position. Thus, it is possible to finally obtain excellent printing precision of image on the second surface.

As described above, the fixing rib 104 projects upstream of the obliquely conveying rollers 101*a* to 101*c* and the obliquely conveying follower roller 101*d* and has substantially the same height as that of the sheet support surface 102*a*1 of the first reference guide surface 102*a*. With this fixing rib 104, the difference in paper-pass length of the both ends of the sheet in the conveying direction is eliminated, and it is possible to reliably adjust the position of the sheet.

It is unnecessary that the height of the fixing rib 104 is exactly the same as that of the sheet support surface 102*a*1 of the first reference guide surface 102*a*, and it has been found from experiment that if the difference between the fixing rib 104 and the first reference guide surface 102*a* of the sheet support surface 102*a*1 is within ±3 mm, the same effect can be obtained.

In this embodiment, if a force of the obliquely conveying rollers 101*a* to 101*c* and the obliquely conveying follower roller 101*d* for adjusting the attitude of the sheet S in the direction of the reference guide surface is sufficient, any of the obliquely conveying rollers 101*a* to 101*c* and the obliquely conveying follower roller 101*d* may be inclined at a given angle.

Next, a second embodiment of the present invention will be explained.

Figure 4:
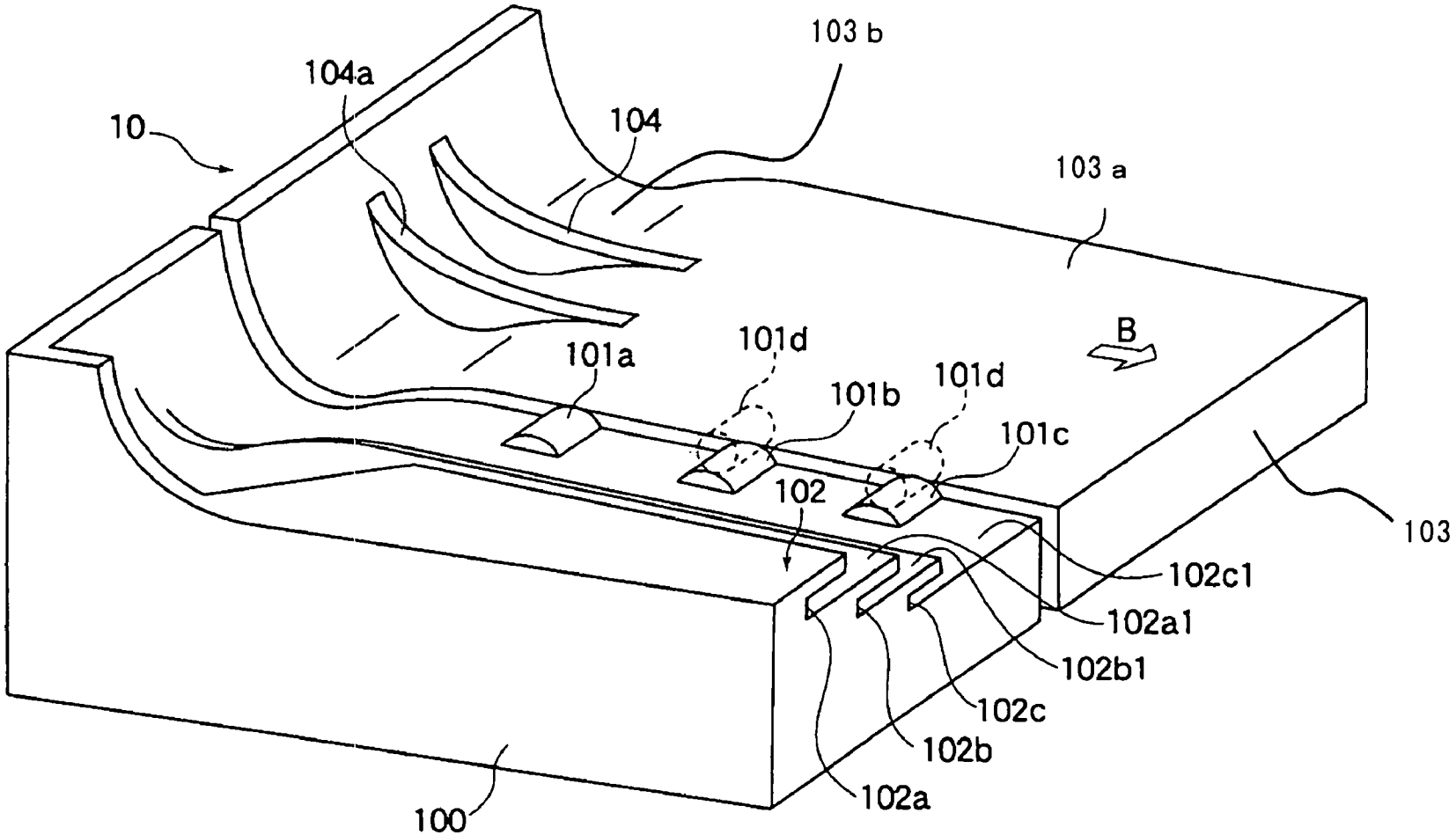
FIG. 4 is a perspective view showing a lower portion of a paper re-feed unit which is a sheet conveying apparatus of a second embodiment of the invention.

FIG. 4 is a perspective view showing a lower portion of the paper re-feed unit which is the sheet conveying apparatus of the second embodiment. In FIG. 4, the same reference numbers as those in FIG. 1 show the same or corresponding elements. Other structure is the same as that of the first embodiment.

In FIG. 4, a fixing rib 104*a* is provided on the fixing rib 104 closer to the reference member. The fixing rib 104*a* is for sheets smaller than those of letter size and A4 size, e.g., for sheets of executive size and B5 size. The fixing rib 104 and the fixing rib 104*a* constitute a support member of this invention.

Figure 5A:
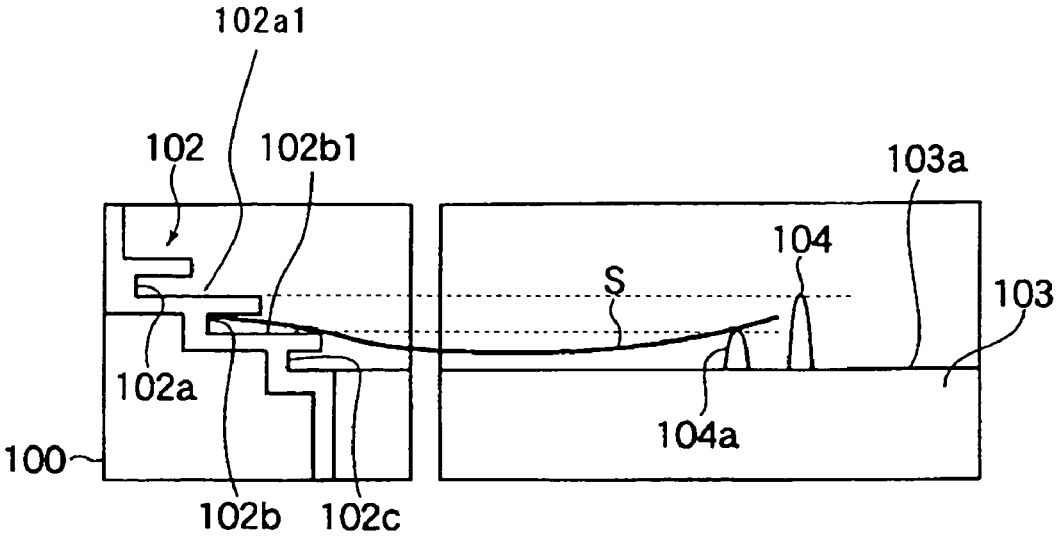
FIG. 5 are a front view and a plan view of the lower portion of the paper re-feed unit.

The fixing rib 104*a* has substantially the same height as that of the sheet support surface 102*b*1 of the second reference guide surface 102*b* of the reference member 102. By providing such a fixing rib 104*a*, it is possible to eliminate a difference in height of both the ends of the sheet S as shown in FIG. 5A. With this configuration, it is possible to reduce a difference in the paper-pass length of both the ends of the sheet in the conveying direction.

Figure 5B:
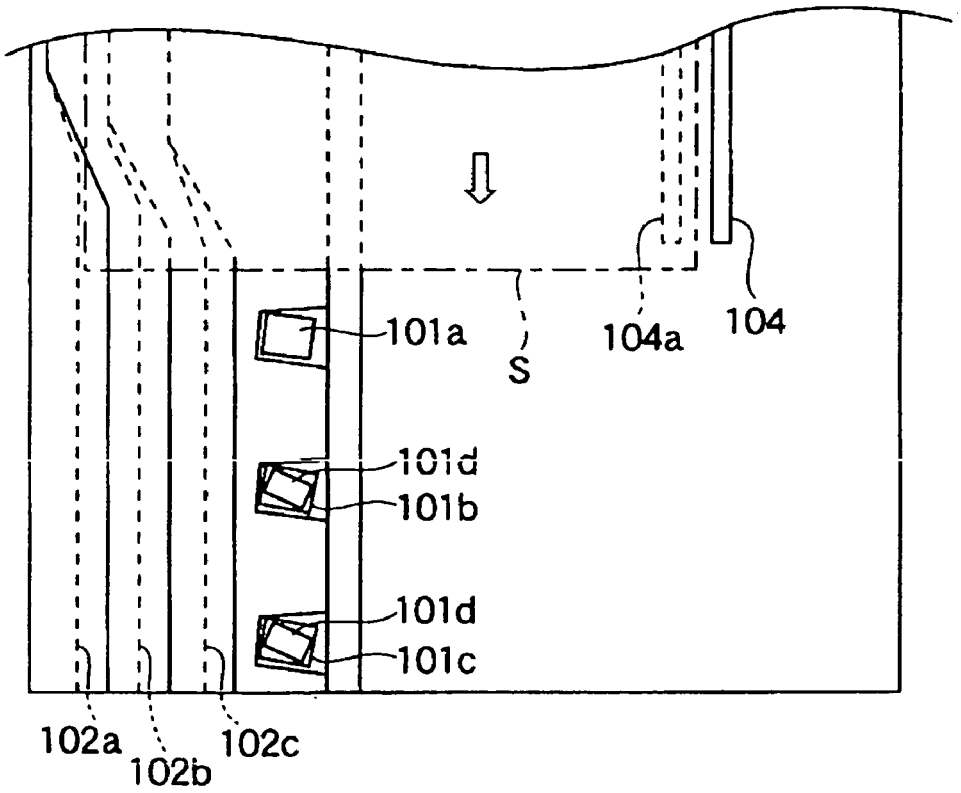

As a result, as shown in FIG. 5B, the reference side end of the sheet S is prevented from escaping from the second reference guide surface 102*b* due to the difference of both the ends in height at upstream of the obliquely conveying roller 101*a*.

When a thin sheet having wide width and low rigidity such as A4 size sheet is to be conveyed, since the fixing rib 104*a* is provided, the height of the end of the A4 size sheet can be maintained by the two fixing ribs 104 and 104*a*, and lateral balance of the sheet can more reliably be kept.

It is unnecessary that the height of the fixing rib 104*a* is exactly the same as that of the sheet support surface 102*b*1 of the second reference guide surface 102*b*, and if the difference between the fixing rib 104*a* and the sheet support surface 102*b*1 of the second reference guide surface 102*b* is within ±3 mm, the same effect can be obtained.

Next, a third embodiment of the present invention will be explained.

Figure 6:
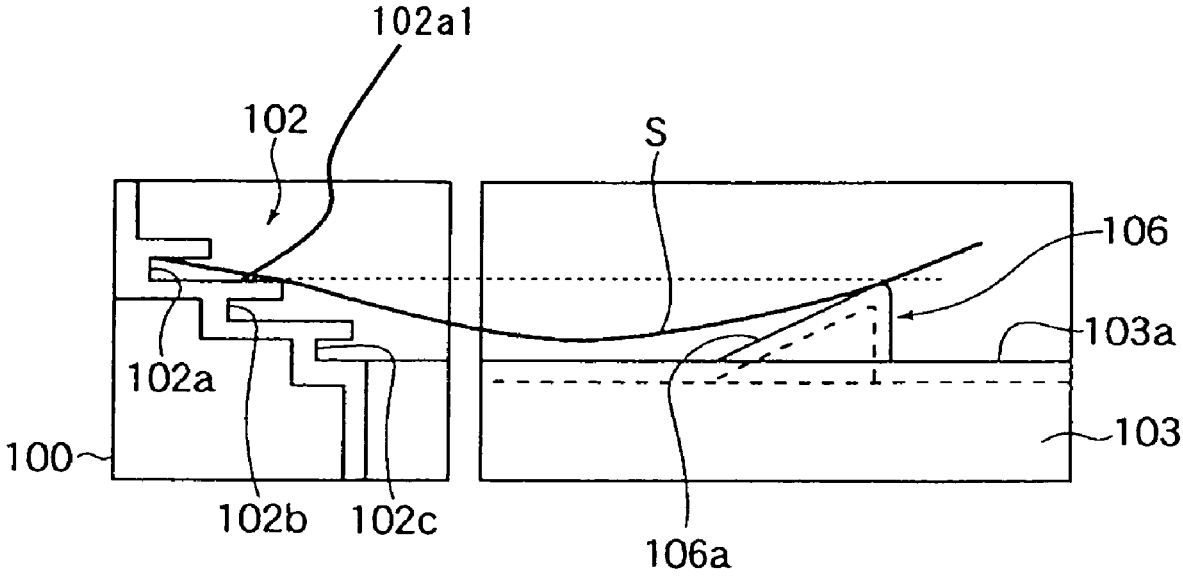
FIG. 6 is a front view showing a lower portion of a paper re-feed unit which is a sheet conveying apparatus of a third embodiment of the invention.

FIG. 6 is a front view showing a lower portion of the paper re-feed unit which is the sheet conveying apparatus of the third embodiment. In FIG. 6, the same reference numbers as those in FIG. 3 show the same or corresponding elements. Other structure is the same as that of the first embodiment.

In FIG. 6, a fixing rib 106 as a support member of the present invention is provided with a guide surface 106*a* which inclines toward the reference member. The guide surface 106*a* is formed such that heights of both ends of a sheet are substantially the same with respect to the center position of the sheet S in its widthwise direction.

By providing the fixing rib 106 having the inclined guide surface 106*a* also, the sheet S can reliably be set along the reference guide surfaces 102*a* to 102*c* by the obliquely conveying rollers 101*a* to 101*c* while the sheet S is re-supplied from the paper re-feed unit 10 to the image forming section, and it is possible to finally obtain excellent printing precision of image on the second surface.

What is claimed is:

1. A sheet conveying apparatus having a positioning mechanism for adjusting a conveying position of a sheet which is conveyed when the sheet is conveyed, the positioning mechanism comprising;

a plurality of reference surfaces formed by a stepwise manner in accordance with a size of a sheet for adjusting a position of the sheet in a direction perpendicular to a sheet-conveying direction, obliquely conveying means for obliquely conveying the sheet and for conveying the sheet while pushing a side end of the sheet against one of the reference surfaces in accordance with the size of the sheet, a curved guide surface provided with a upstream side of the reference surfaces for guiding the sheet, and a support member projecting from the curved guide surface for bringing up an end of the sheet opposite from the reference surfaces.

2. A sheet conveying apparatus according to claim 1, wherein the support member is provided on the opposite side from the plurality of reference surfaces with respect to a center in a direction perpendicular to a sheet conveying direction, and the support member comprises a rib extending in the sheet-conveying direction.

3. A sheet conveying apparatus according to claim 1, wherein the support member is provided on the opposite side from the plurality of reference surfaces with respect to a center in a direction perpendicular to a sheet conveying direction, and the support member comprises a plurality of ribs having different heights in accordance with the heights of the reference surfaces in a widthwise direction of the sheet.

4. A sheet conveying apparatus according to claim 1, further comprising a sheet support surface extending from a lower end of the reference surfaces, and wherein the support member brings up the end of the sheet at substantially the same height as that of said sheet support surface.

5. A sheet conveying apparatus according to claim 4, wherein the support member is provided in a direction away from the plurality of reference surfaces with respect to the center in the widthwise direction of the sheet which is conveyed.

6. A sheet conveying apparatus according to claim 1, wherein the support member has an inclined surface whose height is increased as the inclined surface is separated from the plurality of reference surfaces.

7. A sheet conveying apparatus having a positioning mechanism provided on a sheet conveying passage, the positioning mechanism comprising;

a reference member provided on one end of the conveying passage in a perpendicular direction to a sheet-conveying direction, a plurality of reference surfaces which are provided on the reference member in a stepwise manner in accordance with sizes of sheets, and which define a conveying-reference of the sheet, an obliquely conveying roller which is obliquely disposed on the conveying passage, a curved guide surface provided with an upstream side of the reference surfaces, and a rib which is provided on the curved guide surface and located on the opposite side from the reference surfaces with respect to a center in a direction perpendicular to a sheet conveying direction of the sheet.

8. An image forming apparatus comprising;

an image forming section, and the sheet conveying apparatus according to any one of claims 1 to 7, wherein the image forming section forms an image on a sheet conveyed by the sheet conveying apparatus.

9. An image forming apparatus according to claim 8, wherein in order to form images on both surfaces of a sheet, the sheet conveying apparatus is disposed in a re-feeding passage for again feeding the sheet whose first surface is formed with an image by the image forming section to the image forming section.

10. A sheet conveying apparatus which again feeds a sheet whose first surface is formed with an image by an image forming section to the image forming section for forming an image on a second surface of the sheet which is opposite side from the first surface through a re-feeding passage, the sheet conveying apparatus comprising;

a reference member provided on one end of the re-feeding passage in a perpendicular direction to a sheet-conveying direction, a plurality of reference surfaces which are provided on the reference member in a stepwise manner in accordance with sizes of sheets, and which define a conveying-reference of the sheet, an obliquely conveying roller which is obliquely disposed on the re-feeding passage, a curved guide surface provided with an upstream side of the reference member, and at least one rib which is provided at a position corresponding to one side end of a sheet whose other side end is supported by a sheet support surface which is substantially horizontally extending from each lower end of the plurality of reference surfaces, and which has substantially the same height as that of the sheet support surface.

11. A sheet conveying apparatus according to claim 10, further comprising a plurality of ribs having different heights in accordance with heights of the reference surfaces in a widthwise direction of the sheet.

12. A sheet conveying apparatus according to claim 10, wherein the rib has an inclined surface whose height is increased as the inclined surface is separated from the reference member.

13. An image forming apparatus comprising;

an image forming section, and the sheet conveying apparatus according to any one of claims 10 to 12, wherein the image forming section forms an image on a sheet conveyed by the sheet conveying apparatus.

* * * * *

UNITED STATES PATENT AND TRADEMARK OFFICE

CERTIFICATE OF CORRECTION

Figure 10A:
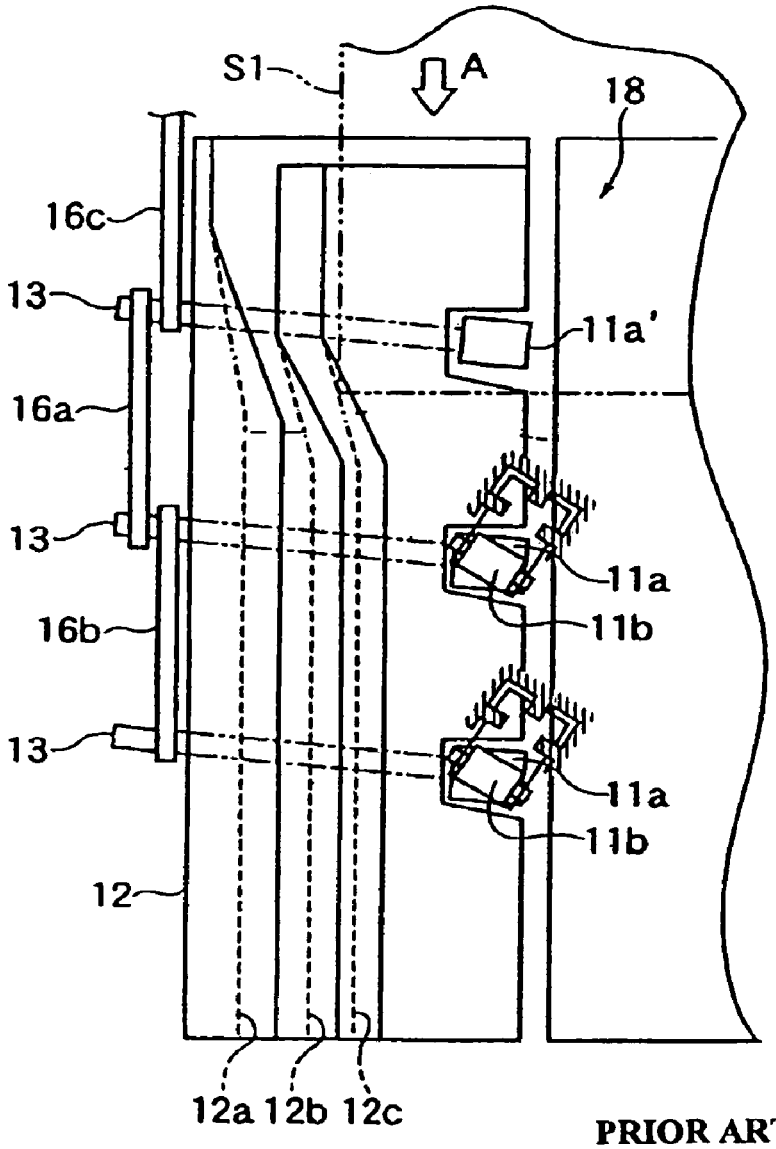
PRIOR ART FIG. 10A
FIG. 10 are a front and a side view showing behavior of a sheet when the sheet is re-fed by means of the conventional paper re-feed unit.
Figure 10B:
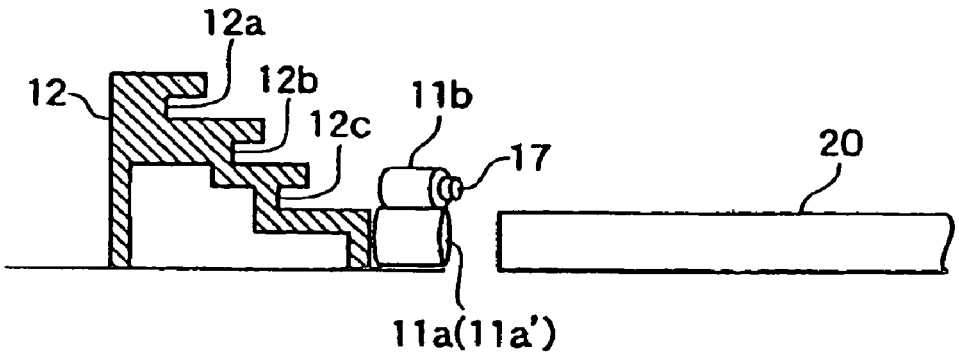
PRIOR ART FIG. 10B

PATENT NO. : 6,993,282 B2
APPLICATION NO. : 10/803927
DATED : January 31, 2006
INVENTOR(S) : Eiichiro Kimizuka It is certified that error appears in the above-identified patent and that said Letters Patent is hereby corrected as shown below:

COLUMN 2:

Line 10, "holds" should read --hold--;
Line 22, "conveying" should read --a conveying--; and
Line 25, "adjust" should read --adjusts--; and
Line 65, "FIG. 10" should read --FIG. 10A-- and "show" should read --shows--.

Figure 9A:
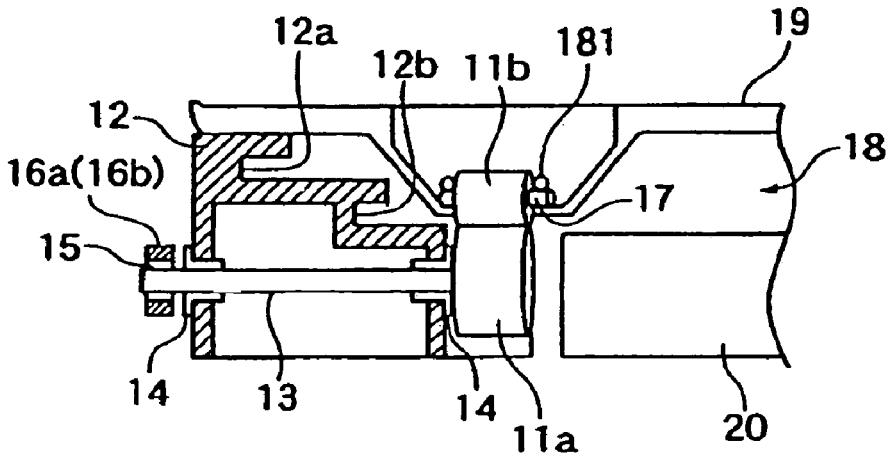
PRIOR ART F I G. 9A
FIG. 9 are a front and a side view for explaining the configuration of the re-feeding passage of the conventional paper re-feed unit.
Figure 9B:
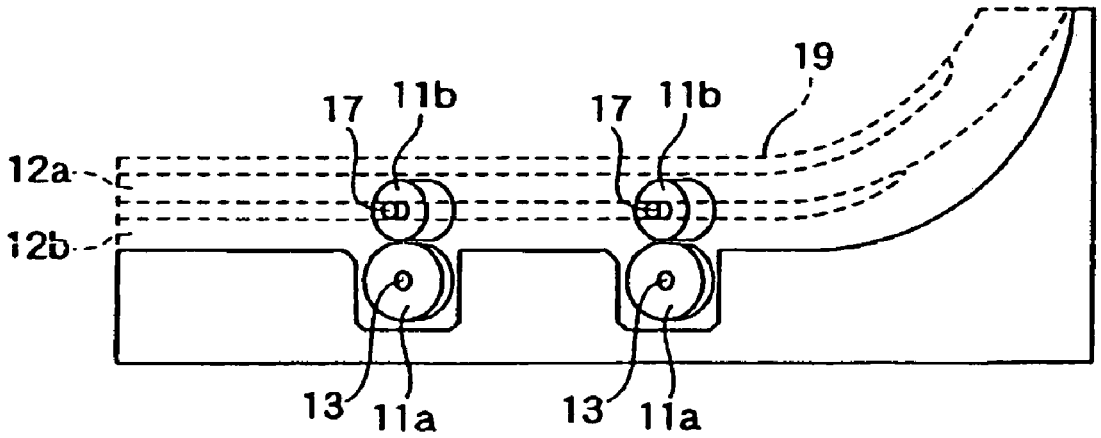
PRIOR ART F I G. 9B
Figure 11A:
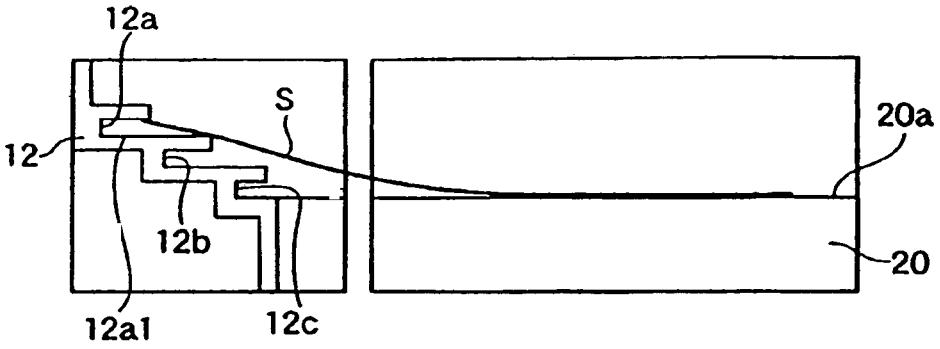
PRIOR ART FIG. 11A
FIG. 11 are diagrams for explaining inconvenience caused when the sheet is re-fed by means of the conventional paper re-feed unit.
Figure 11B:
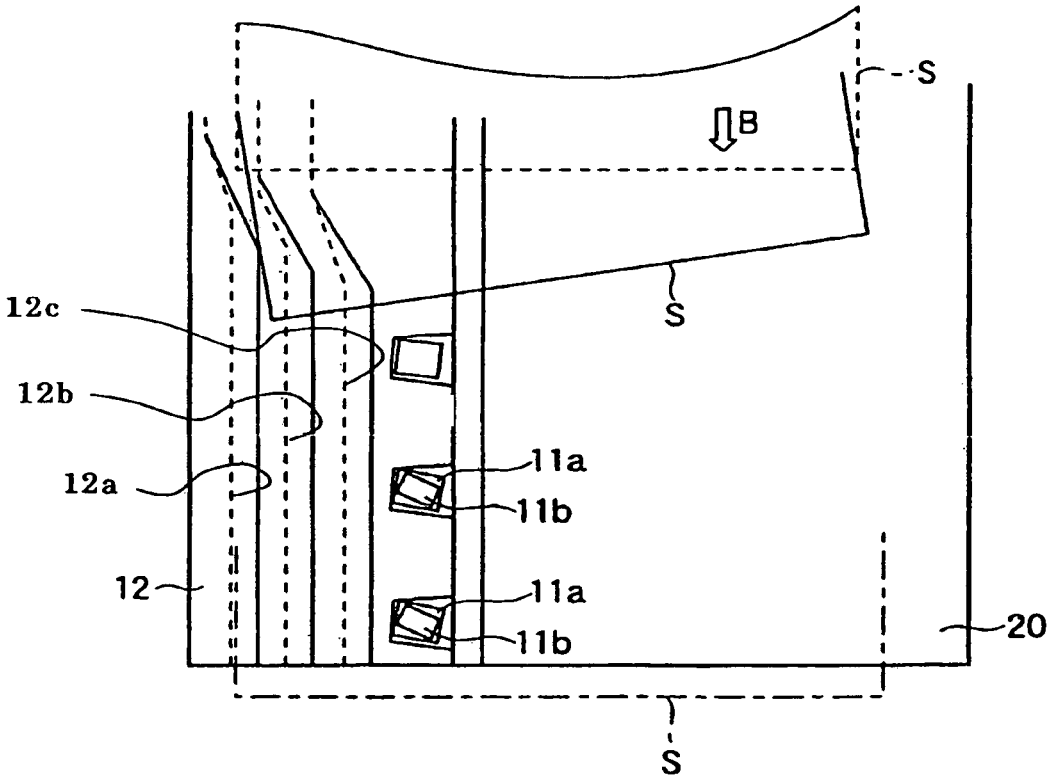
PRIOR ART FIG. 11B

COLUMN 4:

Line 14, "FIG. 3" should read --FIGS. 3A and 3B--;
Line 20, "FIG. 5" should read --FIGS. 5A and 5B--;
Line 30, "FIG. 9" should read --FIGS. 9A and 9B--;
Line 33, "FIG. 10" should read --FIGS. 10A and 10B--;
Line 36, "FIG. 11" should read --FIGS. 11A and 11B--; and
Line 40, "EMBODIMENT" should read --EMBODIMENTS--.

Signed and Sealed this

Twenty-second Day of May, 2007

JON W. DUDAS
*Director of the United States Patent and Trademark Office*